US006612443B2

(12) United States Patent
Kelsey et al.

(10) Patent No.: US 6,612,443 B2
(45) **Date of Patent: *Sep. 2, 2003**

(54) HUTCH CHAMBER FOR JIG

(75) Inventors: Christopher George Kelsey, Glenelg (AU); Ian McKenzie, Adelaide (AU)

(73) Assignee: Evans Deakin Pty Limited, Queensland (AU)

( * ) Notice: Subject to any disclaimer, the term of this patent is extended or adjusted under 35 U.S.C. 154(b) by 0 days.

This patent is subject to a terminal disclaimer.

(21) Appl. No.: 09/938,593

(22) Filed: Aug. 27, 2001

(65) Prior Publication Data

US 2001/0054575 A1 Dec. 27, 2001

Related U.S. Application Data

(63) Continuation of application No. 09/486,081, filed as application No. PCT/AU98/00657 on Aug. 20, 1998, now Pat. No. 6,286,686.

(30) Foreign Application Priority Data

Aug. 20, 1997 (AU) ..... PO8691

(51) Int. Cl.[7] ..... B03B 5/16

(52) U.S. Cl. ..... 209/44; 209/425; 209/426; 209/451; 209/494

(58) Field of Search ..... 209/44, 494, 425, 209/453, 451, 426

(56) References Cited

U.S. PATENT DOCUMENTS

| | | | | |
|---|---|---|---|---|
| 1,141,419 A | | 6/1915 | Senn | 209/44 |
| 2,129,795 A | | 9/1938 | Storsand | 209/44 |
| 4,279,741 A | | 7/1981 | Campbell | 209/44 |
| 4,574,046 A | | 3/1986 | Sprow | 209/44 |
| 4,898,666 A | | 2/1990 | Kelsey | 209/44 |
| 4,998,986 A | | 3/1991 | Campbell | 209/44 |
| 5,114,569 A | | 5/1992 | Kelsey | 209/44 |
| 5,938,043 A | | 8/1999 | Costin et al. | 209/44 |
| 6,244,446 B1 | * | 6/2001 | Schmittel | 209/157 |
| 6,286,686 B1 | * | 9/2001 | Kelsey et al. | 209/44 |

FOREIGN PATENT DOCUMENTS

| | | |
|---|---|---|
| WO | WO 86/04269 | 7/1986 |
| WO | WO 90/00090 | 1/1990 |

* cited by examiner

*Primary Examiner*—Donald P. Walsh
*Assistant Examiner*—Daniel K Schlak
(74) *Attorney, Agent, or Firm*—Smith, Gambrell & Russell, LLP

(57) ABSTRACT

A centrifugal jig has a container mounted for rotation about its longitudinal axis (22), separated into an axial region (32) and a peripheral region by ragging material (41) supported by a screen (30). The peripheral region is composed of a series of hutch chambers (34) with reciprocating wall portions (45) located radially outside the screen (30), for repetitively dilating the ragging.

Also disclosed is a hutch chamber construction applicable to both rotary and non-rotary jigs, having a reciprocating wall portion (45) which includes convergent wall surfaces leading to the hutch chamber concentrate outlet (44).

32 Claims, 2 Drawing Sheets

HUTCH CHAMBER FOR JIG

This application is a continuation of U.S. patent application Ser. No. 09/486,081, filed Feb. 28, 2000 now U.S. Pat. No. 6,286,686, which was a National Stage filing of PCT/AU98/00657, filed Aug. 20, 1998 and claimed foreign priority to Australian Patent Application No. PO8691, filed Aug. 20, 1997. All priority documents are hereby incorporated by reference in their entirety.

BACKGROUND OF INVENTION

This invention relates to jigs which separate materials in a feed mixture on the basis of differing specific gravities and especially, but not exclusively, to centrifugal jigs of the general type described in International Patent Publication Nos. WO86/04269 and WO90/00090, in which a feed slurry is introduced into a rotating chamber bounded radially by a screen provided with ragging on its inner surface, the ragging being dilated repetitively to provide jigging action.

In WO86/04269, the ragging is dilated by pulsing the water in a hutch chamber which surrounds the screen. The water is pulsed by means of a diaphragm positioned at the base of the hutch chamber. In WO90/00090, a number of hutch chambers are circumferentially spaced about the jig screen, with the water in the hutch chambers being pulsed sequentially. Each hutch chamber has a diaphragm positioned below the screen, with the diaphragms being actuated by respective pushrods driven by a central crank assembly.

SUMMARY OF THE INVENTION

The present invention seeks to provide an improved pulsating mechanism for a jig.

In a first form, the invention provides a centrifugal jig having a container mounted for rotation about a longitudinal axis, the container having an axial region, a peripheral region separated from the axial region by ragging which is radially restrained by screen means, means for introducing feed material to the axial region and means for pulsating fluid in said peripheral region so as to repetitively dilate said ragging, characterised in that the pulsating means is located directly radially outwards of said screen means.

A further form of the invention provides a method of separating components of a feed material on the basis of specific gravity in a container of a centrifugal jig which has an axial region, a peripheral region separated from the axial region by ragging which is radially restrained by screen means, including the steps of rotating the container about its longitudinal axis, introducing the feed material to the axial region and repetitively dilating the ragging by means of pulsating means located directly radially outwards of the screen means.

Preferably, the pulsating means includes a reciprocating wall portion of one or more hutch chambers which comprise the peripheral region, most preferably a portion of a radially outer wall of the hutch chamber, including convergent wall surfaces which lead to the hutch chamber concentrate outlet.

Preferably, the reciprocating wall portion of each hutch chamber reciprocates along a substantially radial line of action which intersects with the screen.

A yet further form of the invention, applicable both to centrifugal and gravity (non-rotary) jigs, provides a jig having at least one hutch chamber, said hutch chamber having a reciprocating wall portion which includes convergent wall surfaces leading to a hutch chamber concentrate outlet.

BRIEF DESCRIPTION OF THE DRAWINGS

Further preferred embodiments of the invention shall now be described with reference to the accompanying drawings, in which.

DESCRIPTION OF THE PREFERRED EMBODIMENTS

Figure 1:
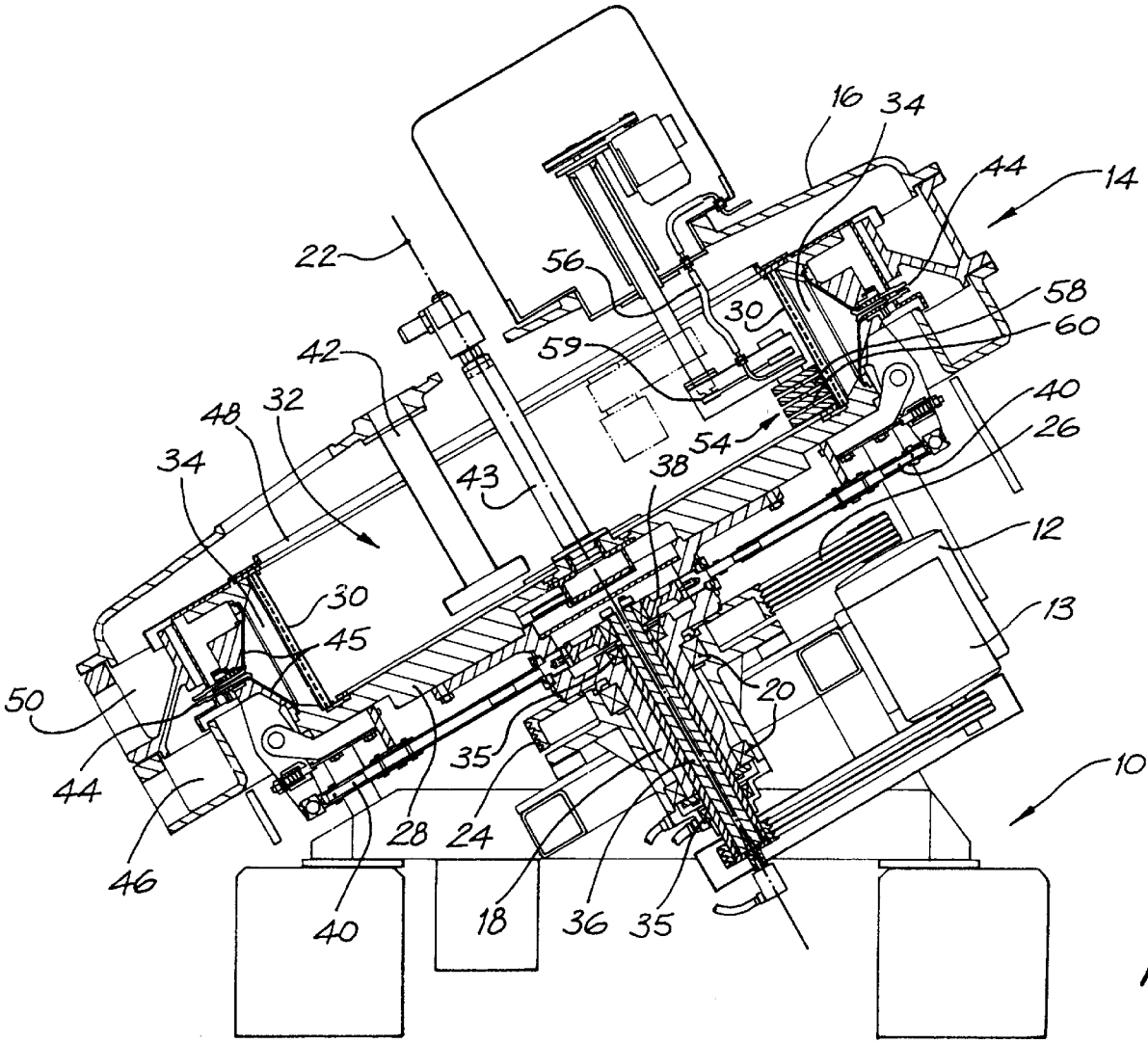
FIG. 1 is a sectional elevation of a centrifugal jig employing a preferred pulsing hutch arrangement.

FIG. 1 shows a centrifugal jig of the general type according to the Applicant's WO90/00090 but employing a pulsion mechanism according to the present invention. The general construction and operation of the jig are described in detail in that patent, the contents of which are incorporated herein by reference, and shall now be described here only briefly.

The centrifugal jig of FIG. 1 has a frame 10 supporting a jig drive motor 12, a crank drive motor 13, a fixed launder arrangement 14 and cover 16 and a jig main shaft 18 which is supported in bearings 20 to rotate about a rotational axis 22.

The main shaft 18 is driven by the jig drive motor 12 through jig drive pulley 24 and jig drive belt 26. Mounted on the main shaft is a screen housing 28 supporting a screen 30 defining an inner chamber 32 and a number of hutch chambers 34 circumferentially spaced about the screen. Mounted inside the jig main shaft for independent rotation in bearings 35 is a crankshaft 36 with crank 38 for reciprocating a respective pushrod 40 for each hutch chamber.

Ragging material 41 (shown in FIG. 2), such as run-of-mill garnet, aluminium alloy or lead glass balls, is provided on the inner surface of the screen 30. The ragging is held against the surface of the screen due to the rotation of the jig. The feed slurry entering the inner chamber 32 through the feed tube 42 migrates to the inner surface of the ragging.

Hutch water is supplied to tube 43, passing through bores (not shown) in the screen housing 30, into each of the hutch chambers 34 circumferentially spaced about the screen. The crank 38 sequentially reciprocates a series of radially extending pushrods 40, with each pushrod in turn reciprocating a respective hutch chamber 34, as will be described below with reference to FIG. 2. The reciprocation of the hutches causes pulsation of the water in the respective hutches.

The ragging is repetitively dilated by the pulsation of the hutch water. This dilation allows the higher specific gravity material in the feed slurry to pass through the ragging and the screen and enter the hutch chambers. The concentrate material then travels along the convergent walls 45 of the hutch to the radially outermost part of the hutch chamber and passes through concentrate outlet spigot 44, which is aligned with a gap in the inner wall of a concentrate launder 46. The lower specific gravity material in the feed slurry does not pass through the ragging, but passes upwardly and escapes past the open top 48 of the inner chamber and then to a tailings launder 50.

The jig of FIG. 1 is mounted for rotation on an inclined axis 22 so that the ragging and feed material in the jig will fall to the lower side of the jig when the jig is stopped or is rotated only slowly. The inclined axis also requires the use of only one outlet from each of the tailings and concentrate launders.

Screen cleaning apparatus 54 is mounted on the stationary jig cover 16 and extends into the high side of the jig, pivoting and retracting between a cleaning position (shown in FIG. 1) for cleaning the screen and a withdrawn position (shown in ghost) radially inwards of the jig feed material, during normal operation of the jig. The cleaning apparatus includes a high pressure water spray 56 and a series of scraper wheels 58 depending from cantilevered cleaner head 59 and acting against the inner surface of the screen, which will typically have a large number of circumferentially elongate slots extending therethrough. The wheels have a series of projecting blades 60 disposed diagonally on their circumference for forcing particles accumulated on the screen to be sheared off at the screen surface and then forced through the screen by the water spray. The wheels are resiliently mounted so as not to cause damage to the screen when an unusually resistant particle is encountered.

In an unillustrated modification, the screen cleaner can include a plurality of spring-mounted buttons on the end face of an enlarged cantilevered cleaner head 59 instead of using scraper wheels 58. The buttons may be moved up and down across the screen surface to shear off lodged particles for removal by the water spray 56.

The screen cleaning arrangement is applicable to centrifugal jigs and other equipment employing rotating screens.

Figure 2:
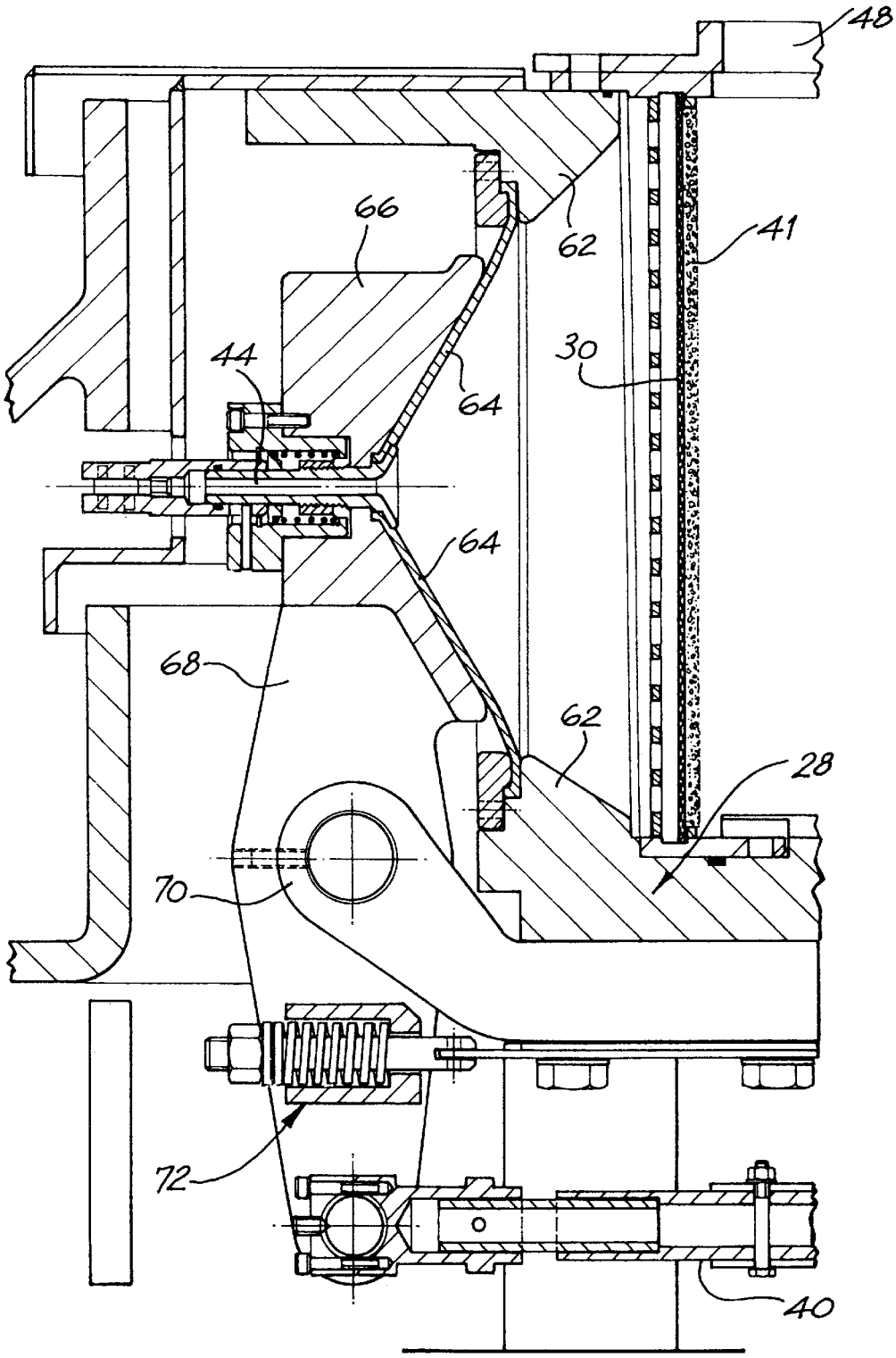
FIG. 2 is a sectional elevation of the screen, hutch and pulsating assembly shown in FIG. 1.

FIG. 2 illustrates the new pulsing hutch assembly in more detail.

With reference to FIG. 2, the inner surfaces of the hutch chamber walls are convergent in the direction of travel of a particle—i.e. radially outwards for a centrifugal jig as illustrated, or downwards for a non-rotary jig (not shown)—for example conical or rectangular pyramidal, with the concentrate outlet spigot 44 at its apex. The radially inwards portion 62 of the hutch is part of the casting of the jig screen housing 28, while the radially outwards part surrounding and attached to the outlet spigot 44 is formed by a diaphragm 64 backed by a support block 66. Each support block is attached to the upper end of the lever 68 pivoting about a fulcrum member 70 attached to the screen housing 28. The lower end of each lever is attached to a respective pushrod 40.

When each pushrod 40 is forced radially outwards by the crank 38, the respective lever 68 forces radially inwards movement of the hutch diaphragm 64, with the resultant pulsation of the hutch water in the hutch chamber causing dilation of the ragging. The concentrate material passes through the ragging and exits the hutch chamber via outlet spigot 44 as discussed above in relation to FIG. 1.

The heavy block 66 behind the diaphragm causes the hutch to be strongly biased toward the radially outwards (non-pulsating) position under influence of the centrifugal motion of the jig. This causes the hutch to quickly and positively return to this position after actuation of the pushrod by the crank, holding the pushrods 40 against the crank 38 with little or no "bounce". This is an advance over the prior art, in which the pulse water pressure was used to force the diaphragm return, and gives protection against damage to the machine in the event of the hutch water supply being interrupted.

A spring actuated lever return 72 may also be provided to hold the hutch in the non-pulsed position when the jig is stationary or is being rotated at very low speeds for routine maintenance.

By providing the pulsators directly and centrally opposite the respective portions of the screen, in accordance with the first form of the invention, the depth of water through which each pulse is transferred from the pulsator to the ragging is decreased. This allows higher pulsation rates with greater coupling between the pulsator and the ragging, resulting in less water hammer and smoother operation of the jig.

Other advantages of preferred forms of the invention are increased energy efficiency and smoother operation caused by a reduction in the volume of the hutch chamber, and thus the volume of water pulsated, as it is no longer necessary to extend the hutch chamber below the level of the screen. The volume of the hutch may be further reduced as the rapid pulsation of the hutch wall portion containing the convergent walls and concentrate outlet assists discharge of the concentrate from the hutch. Higher density concentrate slurries can pass through the hutch and the wall angle of the hutch can be reduced without accumulation of the concentrate on the hutch wall, thus allowing the use of a flatter, more compact hutch. The reduction in hutch volume gives scope for production of higher capacity jigs than capable with the prior art pulsion mechanisms.

A yet further advantage is more even dilation of the bed of ragging, allowing more efficient use of the screen area and therefore increasing the throughput capacity of the jig, due to the pulsator.

While particular embodiments of this invention have been described, it will be evident to those skilled in the art that the present invention may be embodied in other specific forms without departing from the essential characteristics thereof. The present embodiments and examples are therefore to be considered in all respects as illustrative and not restrictive, the scope of the invention being indicated by the appended claims rather than the foregoing description, and all changes which come within the meaning and range of equivalency of the claims are therefore intended to be embraced therein.

What is claimed is:

1. A centrifugal jig having a container mounted for rotation about a longitudinal axis thereof, wherein at least one hutch chamber is mounted to the container so as to rotate therewith about said longitudinal axis, said hutch chamber having a reciprocating wall which includes a concentrate outlet and a convergence that narrows toward said concentrate outlet.

2. The centrifugal jig according to claim 1 wherein said reciprocating wall includes a diaphragm.

3. The centrifugal jig according to claim 2 wherein said diaphragm converges to said concentrate outlet.

4. The centrifugal jig according to claim 3 wherein said concentrate outlet extends from an intermediate region of said diaphragm.

5. The centrifugal jig according to claim 4 wherein said reciprocating wall includes a support block positioned radially externally to said diaphragm.

6. The centrifugal jig according to claim 5 wherein a portion of said support block defines the convergence of said reciprocating wall, and into which a converging portion of said diaphragm extends.

7. The centrifugal jig according to claim 2 wherein said reciprocating wall includes a support block which is supported by said diaphragm and is weighted to bias said reciprocating wall radially outward upon rotation of said chamber.

8. The centrifugal jig according to claim 7 wherein a portion of said support block defines the convergence of said reciprocating wall, and said support block has an intermediate opening having a central axis coinciding with a central axis of said concentrate outlet.

9. The centrifugal jig according to claim 8 wherein said reciprocating wall includes a diaphragm, a portion of which diaphragm extends along the convergence of said reciprocating wall.

10. The centrifugal jig according to claim 1 wherein said container includes a fixed housing, and said reciprocating wall includes a support block and a flexible member, said flexible member extending between said fixed housing and said support block such that said flexible member and support block move closer to and away from said longitudinal axis in operation.

11. The centrifugal jig according to claim 10 further comprising a screen and wherein said fixed housing includes a screen support housing section.

12. The centrifugal jig according to claim 11 wherein said screen support housing section includes a lower end screen contact portion, and a central axis of said concentrate outlet lies on a first plane, taken normal to the longitudinal axis, that is positioned higher on the longitudinal axis than a second plane lying flush on the lower screen contact portion and parallel to the first plane.

13. The centrifugal jig according to claim 12 wherein a third plane lying flush on a lower most edge of said support block and parallel with said first plane is positioned above the second plane.

14. The centrifugal jig according to claim 13 wherein a fourth plane lying flush on a lower most edge of said flexible member and parallel with said first plane is positioned above said second plane and below said third plane, and wherein said flexible member is a diaphragm.

15. The centrifugal jig according to claim 1 wherein said longitudinal axis of said container is an axis which is oblique relative to a horizontal plane.

16. The centrifugal jig according to claim 1 wherein there are a plurality of hutch chambers with said plurality of hutch chambers comprising at least one pair of diametrically opposing hutch chambers.

17. Th centrifugal jig according to claim 1 wherein said reciprocating wall is arranged with respect to said container so as to cause pulsation of a fluid received in said at least one hutch chamber so as to effect respective dilation of a ragging layer in said jig.

18. The centrifugal jig according to claim 1 wherein said centrifugal jig is a gravity jig and wherein said at least one hutch chamber is located radially externally to a screen means which supports ragging.

19. The centrifugal jig according to claim 1 wherein fluid received within said hutch chamber is subjected to a converging flow path which is radially directed so as to focus the fluid toward an outlet in said reciprocating wall, and said outlet in said reciprocating wall opens into a radial extension of said concentrate outlet.

20. The centrifugal jig according to claim 1 wherein said hutch chamber is located radially outside of a screen means which supports ragging.

21. The centrifugal jig according to claim 1 wherein said reciprocating wall is driven by a drive means which includes a lever driven by a pushrod, and a crank means for reciprocating the pushrod.

22. The centrifugal jig according to claim 21 wherein said reciprocating wall includes a support block suspended from the container by a diaphragm connected with the support block an the container.

23. The centrifugal jig according to claim 1 wherein said reciprocating wall is biased to a radial extreme position by means for biasing.

24. The centrifugal jig according to claim 23 wherein said means for biasing includes a weight block which biases the reciprocating wall to an outward radial extreme position based upon centrifugal motion of the jig.

25. The centrifugal jig according to claim 24 wherein said means for biasing includes a spring actuated return which biases the reciprocating wall into the outward radial extreme position.

26. The centrifugal jig according to claim 23 wherein said means for biasing includes a spring actuated return which biases the reciprocating wall into the radial extreme position.

27. The centrifugal jig according to claim 1 wherein said hutch chamber and concentrate outlet are arranged such that a central portion of a flow of liquid flowing through each of said hutch chamber and concentrate outlet during operation is in a common flow direction.

28. The centrifugal jig according to claim 27 wherein the common flow direction is radially outward from the longitudinal axis.

29. A method of operating the centrifugal jig of claim 1 including the steps of directing a concentrate material along the convergence of said hutch chamber and through the concentrate outlet.

30. The centrifugal jig according to claim 1 further comprising a driver which drives the reciprocating wall radially inward and outward.

31. The centrifugal jig according to claim 1 wherein the convergence and the concentrate outlet are arranged to reciprocate as one.

32. The centrifugal jig according to claim 1 further comprising a reciprocation drive which drives reciprocation of the convergence and concentrate outlet of the reciprocating wall.

* * * * *